US011459142B2

(12) United States Patent
Fath

(10) Patent No.: US 11,459,142 B2
(45) **Date of Patent: *Oct. 4, 2022**

(54) CARTON WITH FIRST HINGE PANEL AND SECOND HINGE PANEL

(71) Applicant: Altria Client Services LLC, Richmond, VA (US)

(72) Inventor: Scott Fath, Henrico, VA (US)

(73) Assignee: Akria Client Services LLC, Richmond, VA (US)

( * ) Notice: Subject to any disclaimer, the term of this patent is extended or adjusted under 35 U.S.C. 154(b) by 74 days.

This patent is subject to a terminal disclaimer.

(21) Appl. No.: 17/062,731

(22) Filed: Oct. 5, 2020

(65) Prior Publication Data

US 2021/0015150 A1 Jan. 21, 2021

Related U.S. Application Data

(60) Division of application No. 15/900,055, filed on Feb. 20, 2018, now Pat. No. 10,791,758, which is a (Continued)

(51) Int. Cl.
*B65D 5/42* (2006.01)
*B65D 5/20* (2006.01)
(Continued)

(52) U.S. Cl.
CPC ..... *B65D 5/2009* (2013.01); *B65B 43/10* (2013.01); *B65B 43/265* (2013.01);
(Continued)

(58) Field of Classification Search
CPC ... A47F 5/0068; B65D 5/2009; B65D 5/2095; B65D 5/4208; B65D 5/5021; B65D 5/52
(Continued)

(56) References Cited

U.S. PATENT DOCUMENTS 895,508 A * 8/1908 Smith ..... B65D 5/2095 229/163
1,574,396 A 2/1926 Hoy
(Continued)

FOREIGN PATENT DOCUMENTS

DE 1202213 B 9/1965
FR 983178 A 6/1951
(Continued)

OTHER PUBLICATIONS

Notification of Transmittal of the International Search Report (Forms PCT/ISA/220 and Forms PCT/ISA/210) and the Written Opinion of the InternationalSearching Authority (Forms PCT/ISA/237) dated Oct. 2, 2015, by the European Patent Office in corresponding International Application No. PCT/US2015/041558. (13 pages).

*Primary Examiner* — Nathan J Newhouse
*Assistant Examiner* — Phillip D Schmidt
(74) *Attorney, Agent, or Firm* — Harness, Dickey & Pierce, P.L.C.

(57) ABSTRACT

The carton includes a back panel, a first inner panel, a first surface of the first inner panel contacting a second surface of the back panel, and walls positioned on sides of the back panel, the walls, the back panel and the first inner panel collectively defining a recess. The walls includes a first hinge panel connecting a top panel to the back panel, a second hinge panel connecting a bottom panel to the back panel, a first side panel and a second side panel each connected to the back panel, a top front panel connecting a second inner panel to the top panel, a third surface of the second inner panel contacting the second surface of the back panel, and a fourth surface of the first hinge panel and a fifth surface of the second hinge panel connected to the back panel.

28 Claims, 5 Drawing Sheets

Related U.S. Application Data continuation of application No. 14/805,888, filed on Jul. 22, 2015, now Pat. No. 9,930,913.

(60) Provisional application No. 62/027,504, filed on Jul. 22, 2014.

(51) Int. Cl.

| | |
|---|---|
| ***B65D 5/50*** | (2006.01) |
| ***B65B 43/10*** | (2006.01) |
| ***B65B 43/26*** | (2006.01) |
| ***B65D 5/52*** | (2006.01) |

(52) U.S. Cl.

CPC ..... *B65D 5/2095* (2013.01); *B65D 5/4208* (2013.01); *B65D 5/5021* (2013.01); *B65D 5/52* (2013.01)

(58) Field of Classification Search

USPC .... 229/117.09, 117.12, 122, 122.32, 122.34, 229/163, 164, 119.03, 173, 167, 106; 206/806; 40/661.03

See application file for complete search history.

(56) References Cited

U.S. PATENT DOCUMENTS

| | | | | |
|---|---|---|---|---|
| 2,465,169 | A | 3/1949 | O'Connor | |
| 2,514,384 | A * | 7/1950 | Frankenstein ..... | B65D 5/2009 229/163 |
| 2,535,056 | A | 12/1950 | Frankenstein | |
| 2,781,898 | A | 2/1957 | Desmond et al. | |
| 2,860,823 | A | 11/1958 | Frankenstein | |
| 3,021,948 | A | 2/1962 | Burge | |
| 3,381,878 | A * | 5/1968 | Dewhurst ..... | B65D 5/365 229/163 |
| 3,921,895 | A * | 11/1975 | Ziche ..... | B65D 5/5021 206/486 |
| 4,116,330 | A | 9/1978 | Ellis | |
| 4,687,094 | A | 8/1987 | Allsop et al. | |
| 4,830,185 | A | 5/1989 | Colletti | |
| 5,284,257 | A | 2/1994 | Schum | |
| 10,994,889 | B1 * | 5/2021 | Rumsam ..... | B65D 5/5019 |
| 2004/0250456 | A1 | 12/2004 | Welker | |
| 2013/0334096 | A1 | 12/2013 | Fath | |

FOREIGN PATENT DOCUMENTS

| | | | |
|---|---|---|---|
| FR | 1262021 | A | 5/1961 |
| FR | 86842 | E | 4/1966 |
| JP | 532334 | A | 1/1978 |

* cited by examiner

CARTON WITH FIRST HINGE PANEL AND SECOND HINGE PANEL

CROSS REFERENCE TO RELATED APPLICATION

This application is a divisional application of U.S. patent application Ser. No. 15/900,055, filed Feb. 20, 2018, which is a continuation application of U.S. patent application Ser. No. 14/805,888, filed Jul. 22, 2015, which claims priority under 35 U.S.C. § 119(e) to U.S. Provisional Patent Application No. 62/027,504, filed on Jul. 22, 2014, the entire contents of each of which are incorporated herein by reference.

SUMMARY

A carton is disclosed capable of holding a plurality of articles is disclosed, comprising: a box structure having a back panel, a bottom panel, a top panel, a pair of side panels, a top front panel, a bottom front panel, a first inner panel and a second inner panel, the first inner panel having a pair of slots configured to receive a pair of tabs on an outer free edge of the second inner panel, and wherein the first and second inner panels rest adjacent to the back panel upon placing a plurality of articles within a recess, which is formed between the top front panel, the bottom front panel, the back panel, and the pair of side panels.

A blank is disclosed for forming a carton, which is operable to contain a plurality of articles is disclosed, the blank comprising: a first inner panel connected to an inner top flap panel along a first edge of the inner top flap panel; a top front panel connected to the inner top flap panel along a second edge of the inner top flap panel; a top panel connected to the top front panel along a first edge of the top panel; a top hinge panel connected to the top panel along a second edge of the top panel; a back panel connected to the top hinge panel along a first edge of the back panel, a left side panel and a right side panel connected along a left side edge and a right side edge of the back panel, respectively; a bottom hinge panel connected to the back panel along a second edge of the back panel; a bottom panel connected to the bottom hinge panel along a first edge of the bottom panel; a bottom front panel connected to the bottom panel along a second edge of the bottom panel; an inside bottom front panel connected to the bottom front panel along a first edge of the inside bottom front panel; an inside bottom panel connected to the inside bottom front panel along a first edge of the bottom front panel; and a second inner panel connected to the inside bottom panel along a second edge of the inside bottom panel.

A blank is disclosed for forming a carton, which is operable to contain a plurality of articles is disclosed, the blank comprising: an inner top flap panel connected to a top front panel along a first edge of the top front panel; a top panel connected to the top front panel along a second edge of the top front panel; a top hinge panel connected to the top panel along a second edge of the top panel; a back panel connected to the top hinge panel along a first edge of the back panel; a bottom hinge panel connected to the back panel along a second edge of the back panel; a bottom panel connected to the bottom hinge panel along a first edge of the bottom panel; a bottom front panel connected to the bottom panel along a second edge of the bottom panel; a lower bottom panel having a plurality of openings, each of the plurality of openings configured to receive a lower portion of a tubular, elongated member, and wherein the lower bottom panel is connected to the bottom front panel along a first edge of the lower bottom panel; an inside bottom panel connected to the lower bottom panel along a second edge of the lower bottom panel; and an upper bottom panel having a plurality of openings, each of the plurality of openings configured to receive an upper portion of a tubular, elongated member, and wherein the upper bottom panel is connected to the inside bottom panel along a first edge of the upper bottom panel.

A method is disclosed for displaying a plurality of articles is disclosed, comprising: assembling a box structure having an open recess on a front portion for receiving a plurality of articles, the box structure having a back panel, a bottom panel, a top panel, a pair of side panels, a top front panel, a bottom front panel, a first inner panel and a second inner panel, the first inner panel having a pair of slots configured to receive a pair of tabs on an outer free edge of the second inner panel, and wherein the first and second inner panels rest adjacent to the back panel upon placing a plurality of articles within the open recess, which is formed between the top front panel, the bottom front panel, the back panel and the pair of side panels; placing one or more articles in the open recess; and securing the assembled box structure adjacent to a flip sign.

DETAILED DESCRIPTION

Figure 1:
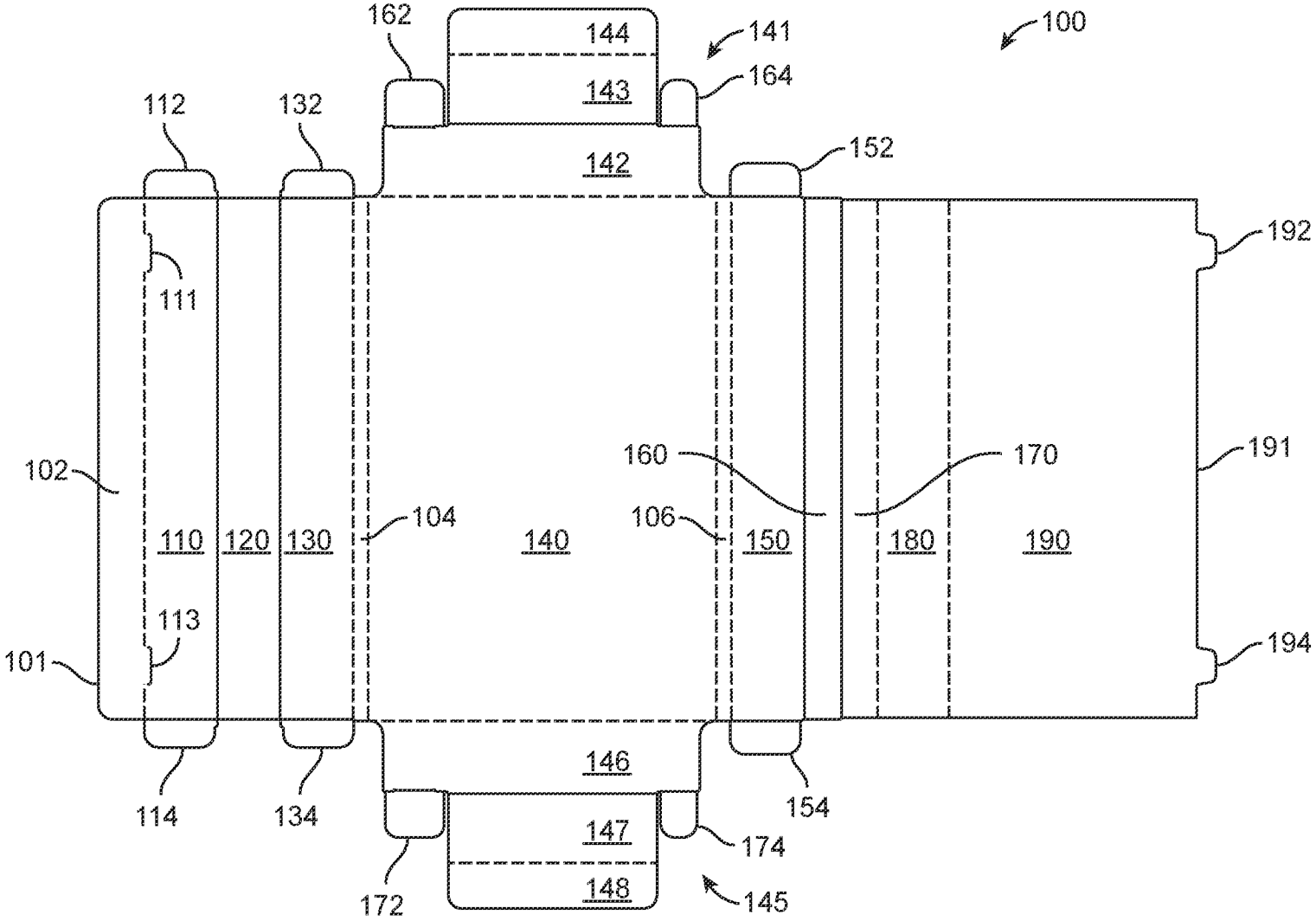
FIG. 1 is a frontside of a blank for forming a carton in accordance with an exemplary embodiment.

In accordance with an exemplary embodiment, a blank 100, 200, and 300 (FIG. 1-3) for forming a carton 400 (FIGS. 4 and 5) operable to contain a plurality of articles or products 500 is disclosed. The carton 400 can be configured to hold a variety of products, for example, cigar boxes, cigarette boxes, liquid cartomizers, and/or electronic cigarette boxes. Advantageously, the carton 400 can use space that is not usually used for retail products. In accordance with an exemplary embodiment, the carton 400 is designed to attach to a flip sign 600 and retain product 500 when the flip sign 600 is rotated upward, which allows access to products that is stored behind the flip sign 600.

In accordance with an exemplary embodiment, a blank 100 for forming a carton 400 (FIG. 4), which is operable to contain a plurality of products 500 is shown in FIG. 1. As shown in FIG. 1, the blank 100 includes a first inner panel 102, which is connected to an inner top flap panel 110 along a fold line to first edge of the inner top flap panel 110. The first inner panel 102 has a free edge 101. A top front panel 120 is connected along a fold line to the inner top flap panel 110 along a second edge of the inner top flap panel 110. A top panel 130 is connected along a fold line to the top front panel 120 along a first edge of the top panel 130. A top hinge panel 104 is connected along a fold line to the top panel 130 along a second edge of the top panel 130. A back panel 140 is connected along a fold line to the top hinge panel 104 along a first edge of the back panel 140. The back panel 140 has a left side panel 141 and a right side panel 145, which are connected along a fold line on a left side edge and a right side edge of the back panel 140, respectively. In accordance with an exemplary embodiment, the left side panel 141 and a right side panel 145 comprises a side panel 142, 146, an inner flap 143, 147, an outer hinge flap 144, 148, and one or more dust flaps 162, 164, 172, 174, respectively. A bottom hinge panel 106 is connected along a fold line to the back panel 140 along a second edge of the back panel 140.

In accordance with an exemplary embodiment, a bottom panel 150 is connected along a fold line to the bottom hinge panel 106 along a first edge of the bottom panel 150. A bottom front panel 160 is connected along a fold line to the bottom panel 150 along a second edge of the bottom panel 150. An inside bottom front panel 170 is connected along a fold line to the bottom front panel 160 along a first edge of the inside bottom front panel 170. An inside bottom panel 180 is connected along a fold line to the inside bottom front panel 170 along a first edge of the inside bottom panel 180, and a second inner panel 190 is connected to the inside bottom panel 180 along a second edge of the inside bottom panel 180.

In accordance with an exemplary embodiment, the inner top flap panel 110, the top panel 130, and the bottom panel 150, each include a left dust flap and a right dust flap, respectively, 112, 114, 132, 134, 152, 154. A fold line between the first inner panel 102 and the inner top flap panel 110 includes a pair of slots 111, 113 configured to receive a corresponding tab 192, 194 on an outer free edge 191 of the second inner panel 190. As shown in FIG. 1, the pair of tabs 192, 194 are located on the outer free edge 191 of the second inner panel 190.

In accordance with an exemplary embodiment, the frontside of the blank 100 as shown in FIG. 1 is folded into the page. In accordance with an exemplary embodiment, as disclosed herein, each of the panels of the blank 100 can be separated from an adjacent panel by a fold or hinge line. In addition, one or more of the hinge or fold lines can be a plurality of perforations extending from one edge of the blank 100 to another edge of the blank 100.

In accordance with an exemplary embodiment, the assembly of the carton 400 from a blank 100 shown in FIG. 1, comprises the folding of the left side panel 141 and the right side panel 145 inward about the left and right side edges of the blank 100. The left side panel 141 and the right side panel 145, which are connected along a left side edge and a right side edge of the back panel 140 each comprises the side panels 142, 146, the inner flaps 143, 147 having a hinge line, and an outer hinge flap 144, 148 are folded about over 180 degrees to form a left and right side panel, respectively.

In accordance with an exemplary embodiment, the blank 100 is folded into the page and forms a carton 400 having a top front panel 120, a top panel 130, a back panel 140, a bottom panel 150, and bottom front panel 160. In accordance with an exemplary embodiment, the top and bottom hinge panels 104, 106 are glued to the frontside of the back panel 140. The corresponding top panels 102, 110, 120, and 130, the bottom panels 150, 160, 170, 180, and 190, and each of the individual panels of the left and right side panels 141 and 145 are folded inward forming a box structure 410 having a frontal recess 420.

In accordance with an exemplary embodiment, dust flaps 112, 132, 152, 162, and 164 are folded inward about the left side panel 141 of the box structure 410. In addition, dust flaps 114, 134, 154, 172, and 174 are folded inward about the right side panel 145 of the box structure 410.

Figure 2:
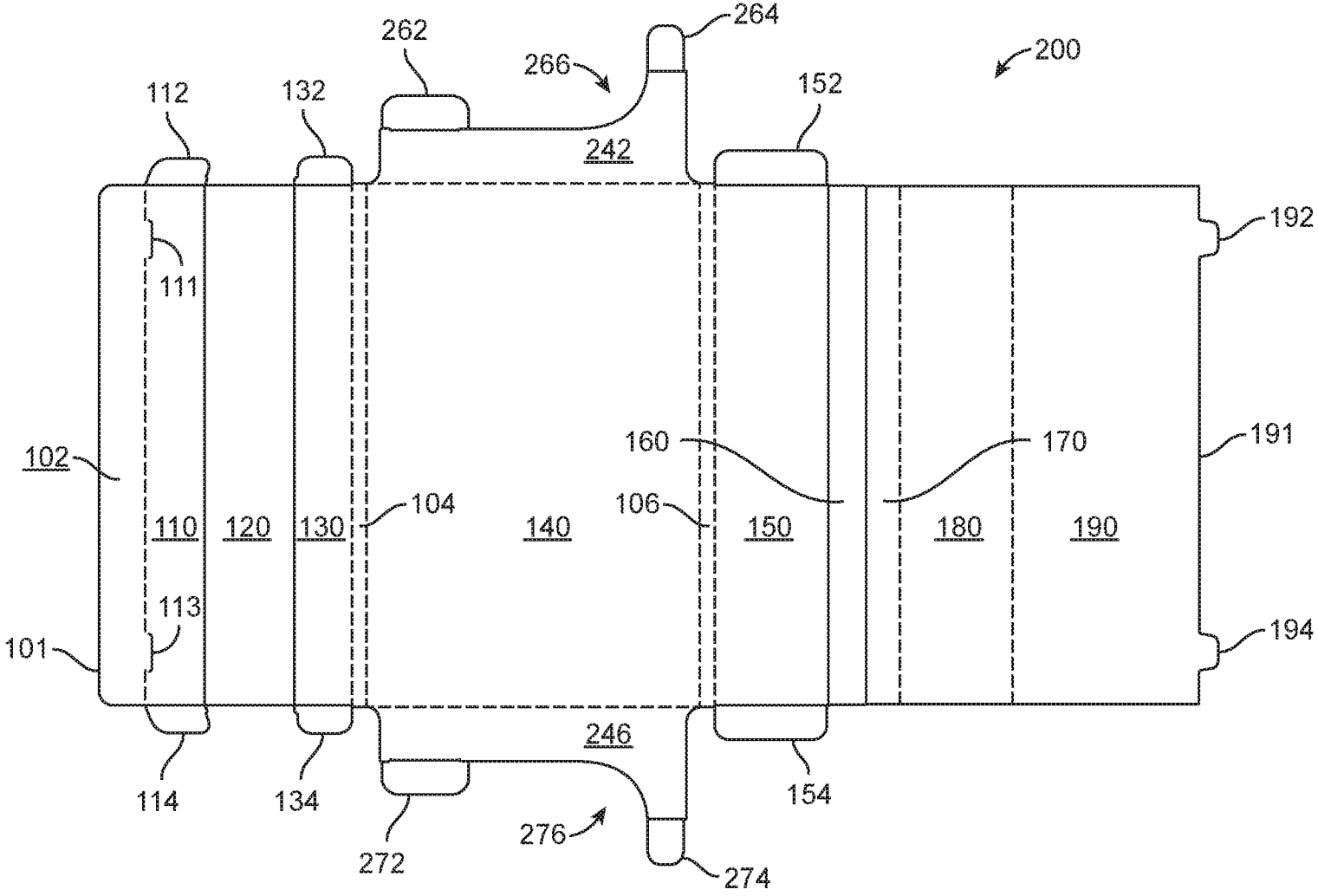
FIG. 2 is a frontside of a blank for forming a carton in accordance with an exemplary embodiment.

FIG. 2 is a frontside of a blank 200 for forming a carton in accordance with an exemplary embodiment. As shown in FIG. 2, the blank 200 includes a first inner panel 102, which is connected to an inner top flap panel 110 along a first edge of the inner top flap panel 110. A top front panel 120 is connected to the inner top flap panel 110 along a second edge of the inner top flap panel 110. A top panel 130 is connected to the top front panel 120 along a first edge of the top panel 130. A top hinge panel 104 is connected to the top panel 130 along a second edge of the top panel 130. A back panel 140 is connected to the top hinge panel 132 along a first edge of the back panel 140, the back panel 140 having a left side panel 242 and a right side panel 246 is connected along a left side edge and a right side edge of the back panel 140, respectively. A bottom hinge panel 106 is connected to the back panel 140 along a second edge of the back panel 140.

A bottom panel 150 is connected to the bottom hinge panel 106 along a first edge of the bottom panel 150. A bottom front panel 160 is connected to the bottom panel 150 along a second edge of the bottom panel 150. An inside bottom front panel 170 is connected to the bottom front panel 160 along a first edge of the inside bottom front panel 170. An inside bottom panel 180 is connected to the inside bottom front panel 170 along a first edge of the inside bottom panel 180, and a second inner panel 190 is connected to the inside bottom panel 180 along a second edge of the inside bottom panel 180.

In accordance with an exemplary embodiment as shown in FIG. 2, the inside top front panel 110, the top panel 130, and the bottom panel 150, each include a left dust flap and a right dust flap, respectively, 112, 114, 132, 134, 152, 154. A fold line between the first inner panel 102 and the inside top front panel 110 includes a pair of slots 111, 113 configured to receive a corresponding tab 192, 194 on an outer free edge 191 of the second inner panel 190. As shown in FIG. 2, the pair of tabs 192, 194 are located on the outer free edge 191 of the second inner panel 190. The first inner panel 102 has a free edge 101.

The blank 200 also includes a left side panel 242 and the right side panel 246, which are connected along a left side edge and a right side edge, respectively, of the back panel 140. In accordance with an exemplary embodiment, each of the side panels 242, 246 has a greater depth on an edge adjacent to the bottom hinge panel 106 than a depth adjacent to the top hinge panel 104. As shown in FIG. 2, each of the side panels 242, 246 has a curved inner edge 266, 276 extending in a direction from the top panel 130 to the bottom panel 150.

Upon assembly of the blank 200 into a carton 400, the bottom of the carton 400 has a greater depth than the top of the carton 400. In addition, as shown in FIG. 2, the bottom panel 150 has a greater depth than the top panel 130. In accordance with an exemplary embodiment, upon assembly of the carton 400, the curved inner edges 266, 276 extend from a front edge of the bottom panel 150 to a front edge of the top panel 160. The left side panel and the right side panels 242, 246 also each include a pair of dust flaps 262, 264, 272, 274 on an outer free edge of the side panels 242, 264. In accordance with an exemplary embodiment, the top and bottom hinge panels 104, 106 are glued to the frontside of the back panel 140.

Figure 3:
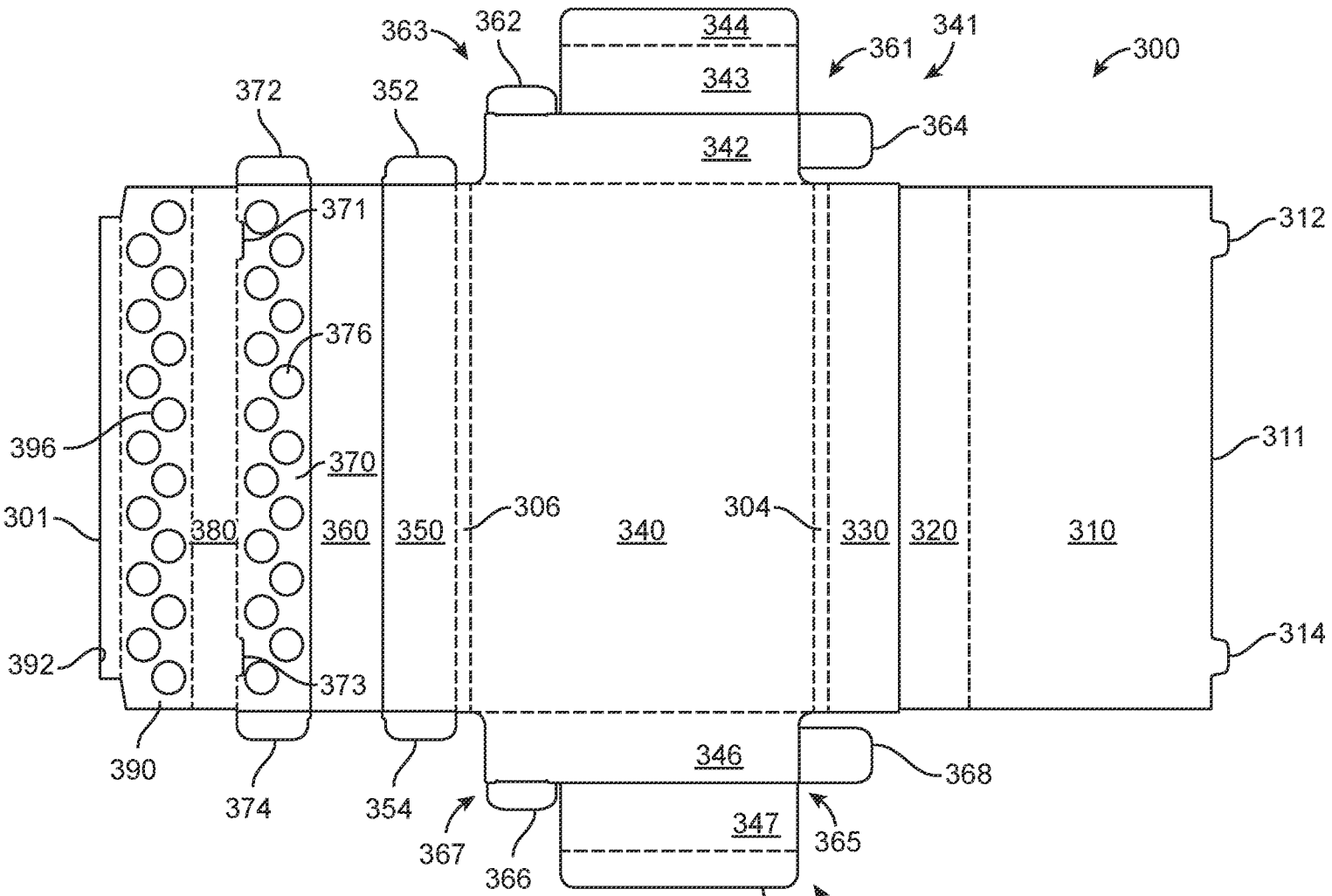
FIG. 3 is a frontside of a blank for forming a carton in accordance with an exemplary embodiment.

FIG. 3 is a blank 300 for forming a carton in accordance with another exemplary embodiment. As shown in FIG. 3, the blank 300 includes an inner top flap panel 310 connected along a fold line to top front panel 320. The top front panel 320 is connected along a fold line to a top panel 330 along a second edge of the top front panel 320. The top front panel 320 is connected along a fold line to a first edge of the top panel 330. A top hinge panel 304 is connected along a fold line to the top panel 330 along a second edge of the top panel 330. A back panel 340 is connected along a fold line to the top hinge panel 304 along a first edge of the back panel 340, the back panel 340 having a left side panel 341 and a right side panel 345, which are connected along a fold line to a left side edge and a right side edge of the back panel 340, respectively. A bottom hinge panel 306 is connected along a fold line to the back panel 340 along a second edge of the back panel 340.

In accordance with an exemplary embodiment, a bottom panel 350 is connected along a fold line to the bottom hinge panel 306 along a first edge of the bottom panel 350. A bottom front panel 360 is connected along a fold line to the bottom panel 350 along a second edge of the bottom panel 350. A lower bottom panel 370 is connected along a fold line to the bottom front panel 360 along a first edge of the lower bottom panel 370. The lower bottom panel 370 has a plurality of openings 376, each of which is configured, for example, to receive one or more tubular, elongated members (not shown). An inside bottom panel 380 is connected along a fold line to the lower bottom panel 370 along a second edge of the bottom front panel 370, and an upper bottom panel 390 having a plurality of openings 396 configured to receive a tubular, elongated member is connected to the inside bottom panel 380 along a second edge of the inside bottom panel 380. The blank 300 also includes a bottom tuck panel 392 connected along a fold line to the upper bottom panel 390.

The plurality of openings 376, 396 can be arranged in two or more rows of openings 376, 396. The plurality of openings 376 within the lower bottom panel 370 and the plurality of openings 396 within the upper bottom panel 390 are configured to align within one another during assembly of the carton 400. In accordance with an exemplary embodiment, the plurality of openings 376, 396 are configured to be offset from one another within each of the panels 370, 390. The carton 400 can be configured to hold 5 to 25 tubular, elongated members (or tubes). For example, as shown in FIG. 3, the blank 300 has 15 openings 376, 396, which are configured to receive 15 tubular, elongated members or tubes.

The blank 300 also includes a left side panel 341 and a right side panel 345, which are connected along a left side edge and a right side edge of the back panel 340. Each of the side panels 341, 345 includes an inner side panel 342, 346, an inner flap 343, 347, and an outer hinge flap 344, 348. Each of the inner side panels 342, 346 also includes a pair of dust flaps 362, 364, 366, 368, which are positioned on a top edge 361, 365 and a lower outer edge 363, 367 of the inner side panels 342, 346.

In accordance with an exemplary embodiment, the bottom panel 350 and the lower bottom panel 370 each include a left dust flap and a right dust flap 352, 354, 372, 374. A fold line between the lower bottom panel 370 and the inside bottom panel 380 includes a pair of slots 371, 373 configured to receive a corresponding tab 312, 314 on an outer free edge 311 of the top flap panel 310.

In accordance with an exemplary embodiment, the blank 300 as shown in FIG. 3 is folded into the page. In accordance with an exemplary embodiment, each of the panels of the blank 300 can be separated from an adjacent panel by a fold or hinge line. In addition, one or more of the hinge or fold lines can be a plurality of perforations extending from one edge of the blank 300 to another edge of the blank 300. In accordance with an exemplary embodiment, the top hinge panel 304 and the bottom hinge panel 306 are glued to the frontside of the back panel 340 during assembly.

In accordance with exemplary embodiment, the blank 100, 200, 300 is formed of a material selected from the group consisting of cardboard, paperboard, plastic, metal, or combinations thereof. For example, in a preferred embodiment, the blank 100, 200, 300 is formed of cardboard having a weight ranging from about 100 grams per square meter to about 350 grams per square meter. In accordance with another exemplary embodiment, the blank 100, 200, 300 includes one or more of printing, embossing, debossing, embellishments, and combinations thereof on an outer surface of the blank 100, 200, and 300.

In the preferred embodiment, the blank 100, 200, 300 may be formed from any suitable materials including, but not limited to, cardboard, paperboard, plastic, metal, or combinations thereof. Preferably, the blank 100, 200, 300 is formed from one or more folded laminar cardboard blanks. Also preferably, the cardboard has a weight ranging from about 100 grams per square meter (gsm) to about 350 grams per square meter.

In accordance with an exemplary embodiment, the blank 100, 200, 300 has a height of about 50 cm to 70 cm, and more preferably about 60 cm to 65 cm from a free edge 101, 301 of the first inner panel 102 or the bottom tuck panel 392 to the free edge 191, 311 of the second inner panel 190 or an inner top flap panel 310. In accordance with an exemplary embodiment, the blank 100, 200, 300 has a width of about 45 cm to about 50 cm in an unassembled state. In accordance with an exemplary embodiment, the carton 400 in an assembled state has a width of about 25 cm to about 30 cm, a height of about 17 cm to about 20 cm, and a depth of about 3 cm to about 7 cm. For example, in accordance with an embodiment shown in FIG. 2, the assembled carton 400 can have a width of about 28 cm to 29 cm, a height of about 18 cm to 19 cm and a depth of about 6 cm to 7 cm on lower or bottom portion thereof, and about 3 cm to 4 cm on a top portion thereof.

Figure 4:
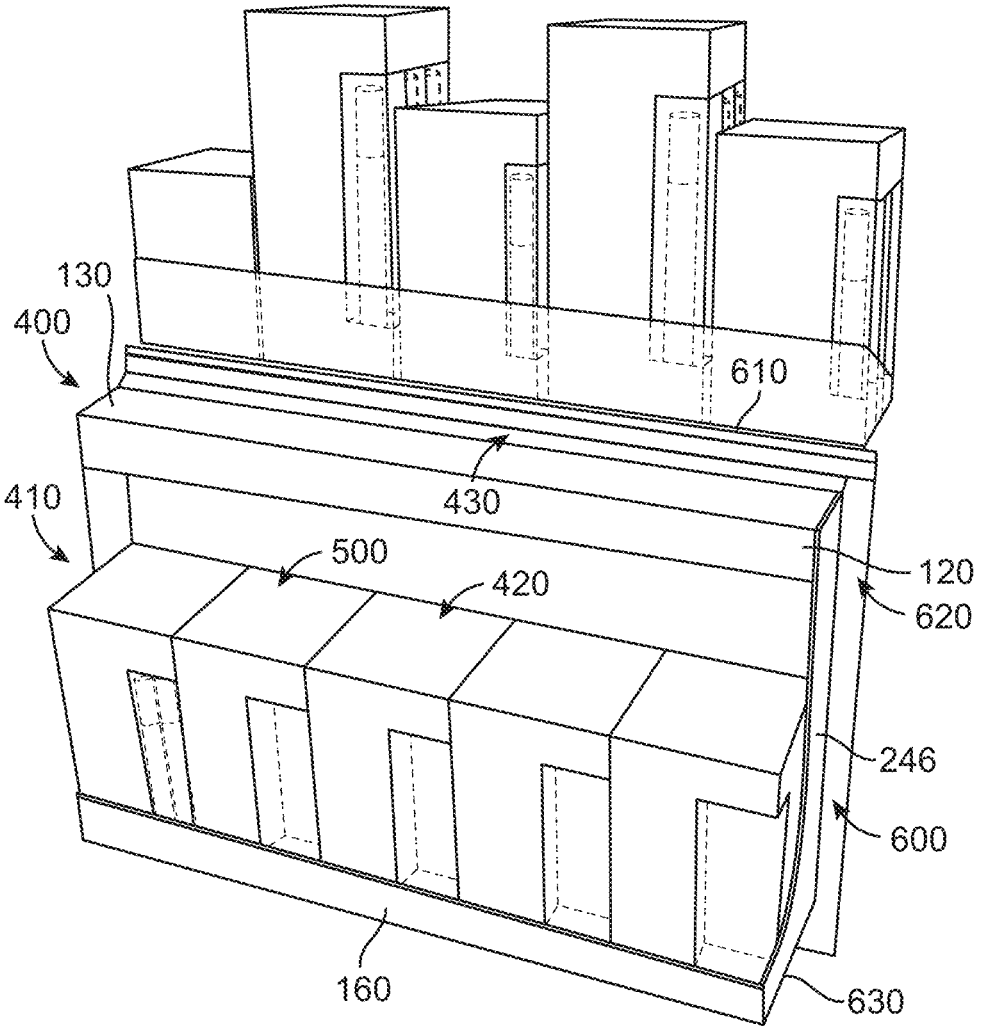
FIG. 4 is a perspective view of an assembled carton on a flip sign in accordance with an exemplary embodiment.
Figure 5:
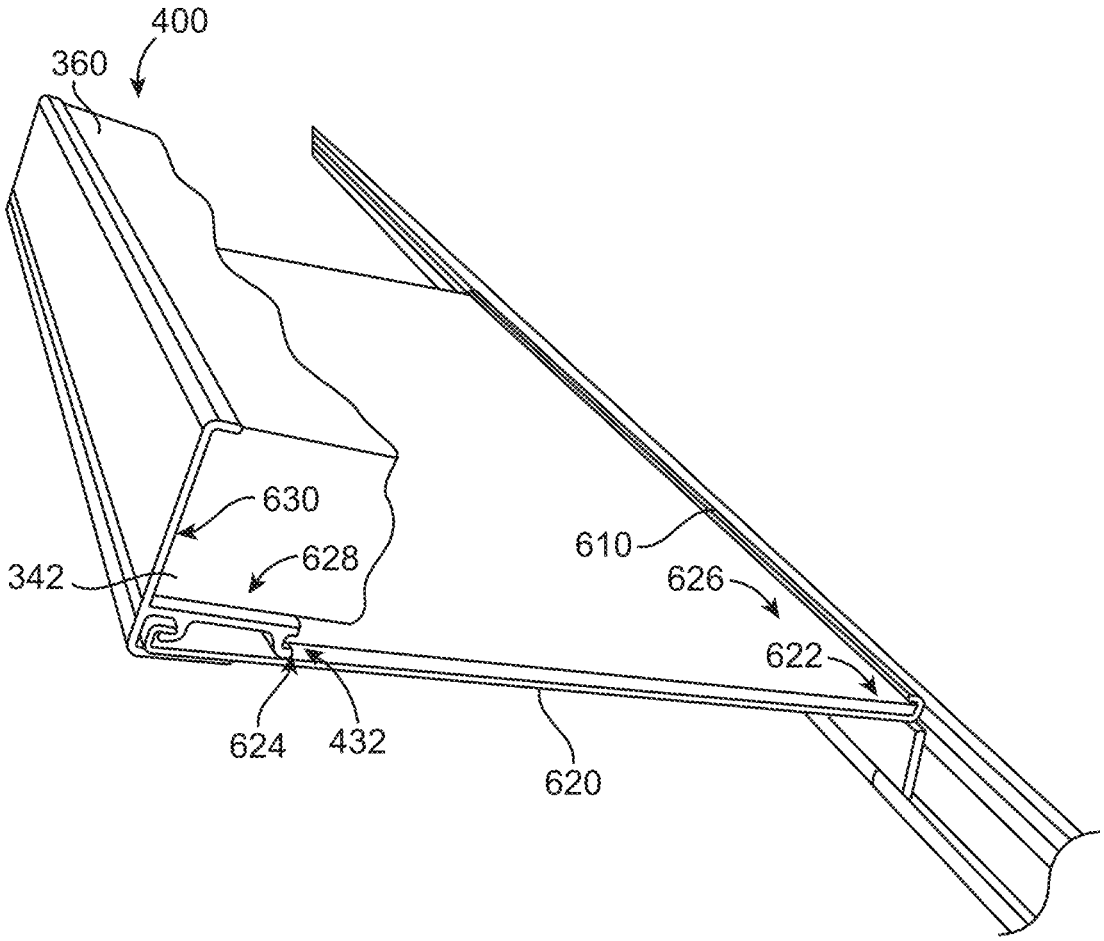
FIG. 5 is a perspective view of an assembled carton on a flip sign in accordance with an exemplary embodiment.

FIGS. 4 and 5 are perspective views of an assembled carton 400 on a flip sign 600 in accordance with an exemplary embodiment. As shown in FIGS. 4 and 5, the carton 400 can be configured to fit or slide onto a flip sign 600 in place of a marketing or advertising sign or placard (not shown). The flip sign 600 is preferably pivotally supported on a store rack or shelving, which houses additional product, which is not on display. In use, the flip sign 600 can be rotated upward to access the store rack or shelving behind the flip sign 600.

In accordance with an exemplary embodiment, the flip sign 600 preferably includes a hinge 610 and a front panel 620. The front panel 620 of the flip sign 600 can also include a pair of slots 622, 624 configured to receive marketing and/or advertising materials in the form of a cardboard or plastic sign or placard (not shown). In accordance with an exemplary embodiment, the assembled carton 400 includes a pair of flanges 430, 432 formed on a backside of the carton 400 by the top hinge panel 104, 304 and the bottom hinge panel 106, 306, respectively. The pair of flanges 430, 432 on the carton 400 is configured to engage the slots 622, 624 on an upper end 626 and a lower end 628, respectively of the flip sign 600, which secures the carton 400 to a frontside of the flip sign 600 (the depiction of the carton 400 in FIG. 5 is truncated to better depict the flip sign 600).

In accordance with an exemplary embodiment, the carton 400 can be configured to hold one or more articles (or packs) 500, for example, cigars, cigarettes, liquid cartomizers and/ or e-cigarette boxes. For example, the carton 400 can be configured to hold a thin boxed product, such a 5 (five) pack cigar box or liquid cartomizer, or alternatively, a deep boxed product, such as a cigar box for 25 (twenty-five) cigars or electronic charging kits.

In accordance with an exemplary embodiment as shown in FIG. 5, the flip sign 600 can also include an optional lower panel or extrusion 630, which extends perpendicular to the front panel 620. The lower panel or extrusion 630 can be configured to fit within one of the slots 624 within the front panel 620 of the flip sign 600, and is configured to assist in holding the assembled carton 400 on the flip sign 600. In accordance with an exemplary embodiment, the assembled carton 400 can slide into and/or be secured to the lower panel 630 and/or front panel 620 of the flip sign 600 as shown.

In accordance with an exemplary embodiment, the one or more articles or boxes 500 are preferably retained in the recess 420 between the inner top flap panel 110 and the inside bottom panel 180 of the assembled blank 100, 200 as shown in FIGS. 1 and 2, and within the plurality of openings 376, 396 within the lower bottom panel 370 and the upper bottom panel 390 of the blank 300 as shown in FIG. 3. The recess 420 is configured such that the articles 500 are retained within the recess 420 when the flip sign 600 is lifted upward to access the product stored on the shelves behind the flip sign 600.

In the preferred embodiment, exterior surfaces of the carton 400 may be printed, embossed, debossed or otherwise embellished with manufacturer or brand logos, trademarks, slogans and other consumer information and indicia.

As used herein, the terms "front", "back", "upper, "lower", "side", "top", "bottom", "left", "right" and other terms used to describe relative positions of the components of the box refer to the carton 400 in an upright position.

In accordance with an exemplary embodiment, the fold and/or score lines are 2 pt. rule.

As used herein, the term "longitudinal" refers to a direction from bottom to top or vice versa of the carton 400. The term "transverse" refers to a direction perpendicular to the longitudinal direction.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines can include: a score line, such as lines formed with a blunt scoring knife, or the like, which creates a crushed portion in the material along the desired line of weakness. In addition, cut line extends partially into and/or completely through the material along the desired line of weakness so as to separate one portion of a panel or panels from another portion of a panel or panels.

In this specification, the word "about" is sometimes used in connection with numerical values to indicate that mathematical precision is not intended. Accordingly, where the word "about" is used with a numerical value, that numerical value should be interpreted to include a tolerance ±10% of the stated numerical value.

It will now be apparent to those skilled in the art that the foregoing specification describes with particularity a box. Moreover, it will also be apparent to those skilled in the art that various modifications, substitutions, variations, and equivalents exist for claimed features of container. Accordingly, it is expressly intended that all such modifications, substitutions, variations, and equivalents for claimed features of the container, which fall within the spirit and scope of the invention as defined by the appended claims, be embraced thereby.

What is claimed is:

1. A carton, comprising:

a back panel;

a first inner panel, a first surface of the first inner panel contacting a second surface of the back panel; and walls positioned on sides of the back panel, the walls, the back panel and the first inner panel collectively defining a recess, the walls including, a first hinge panel connecting a top panel to the back panel, a second hinge panel connecting a bottom panel to the back panel, a first side panel and a second side panel each connected to the back panel, a top front panel connecting a second inner panel to the top panel, a third surface of the second inner panel contacting the second surface of the back panel, and a fourth surface of the first hinge panel and a fifth surface of the second hinge panel connected to the back panel.

2. The carton of claim 1, wherein the fourth surface of the first hinge panel and the fifth surface of the second hinge panel are adhesively connected to the second surface of the back panel.

3. The carton of claim 2, wherein the first hinge panel and the back panel combine to form a first flange on a first end of the carton, and the second hinge panel and the back panel combine to form a second flange on a second end of the carton.

4. The carton of claim 1, wherein an inner top flap panel is connected between the top front panel and the second inner panel.

5. The carton of claim 4, wherein the top panel at least partially forms a top surface of the carton, and the top front panel is in a first plane that is about parallel to a second plane of the second surface of the back panel.

6. The carton of claim 4, wherein a first fold line between the second inner panel and the inner top flap panel define at least one first slot, and at least one first tab extends from the first inner panel, the at least one first tab being retained inside the at least one first slot.

7. The carton of claim 1, wherein the walls include a bottom front panel connecting an inside bottom front panel to the bottom panel, and an inside bottom panel connecting the inside bottom front panel to the first inner panel.

8. The carton of claim 4, wherein the walls include a bottom front panel connecting an inside bottom front panel to the bottom panel, and an inside bottom panel connecting the inside bottom front panel to the first inner panel.

9. The carton of claim 8, wherein a pair of dust flaps are on a first end and a second end of each of the inner top flap panel, the top panel and the bottom panel.

10. The carton of claim 7, wherein a sixth surface of the bottom front panel contacts a seventh surface of the inside bottom front panel, and an eighth surface of the inside bottom panel contacts a ninth surface of the bottom panel.

11. The carton of claim 7, wherein the bottom panel at least partially forms a bottom surface of the carton, and the bottom front panel is in a third plan that is about parallel to a second plan of the second surface of the back panel.

12. The carton of claim 7, wherein a first width of the bottom panel from the bottom front panel to the second hinge panel, is greater than a second width of the top panel from the top front panel to the first hinge panel.

13. The carton of claim 1, wherein the first side panel and the second side panel each have a curved inner edge that respectively extend from a first side edge and a second side edge of the back panel.

14. The carton of claim 13, wherein the curved inner edge gradually extends away from back panel, from a first end to a second end of the curved inner edge, a first dust flap extends away from the first end of the curved inner edge, and a second dust flap extends away from the second end of the curved inner edge.

15. The carton of claim 1, wherein the first side panel and the second side panel each include, an inner side panel, an outer hinge flap panel, and a middle flap panel between the inner side panel and the outer hinge flap panel.

16. The carton of claim 15, wherein a third dust flap and a fourth dust flap extend from a first portion and a second portion of an outer side edge of the inner side panel, respectively, and the middle flap panel is between the third dust flap and the fourth dust flap.

17. The carton of claim 15, wherein a third dust flap extends from a portion of a second side edge of the inner side panel, a fourth dust flap extends from a portion of first end edge of the inner side panel, the second side edge and the first end edge being about perpendicular to each other, and the middle flap panel is between the third dust flap and the fourth dust flap.

18. A display, comprising:

the carton of claim 1; and one or more consumer products within the recess, the one or more consumer products being accessible from within the recess.

19. The display of claim 18, further comprising:

a flip sign, the flip sign being configured to connect to a storage rack, the flip sign including a first slot and a second slot on respective ends of the flip sign, the first hinge panel and the back panel of the carton combining to form a first flange on a first end of the carton, the second hinge panel and the back panel combining to form a second flange on a second end of the carton, and wherein the first flange fits into the first slot and the second flange fits into the second slot to hold the carton on the flip sign.

20. A carton, comprising:

a back panel;

an inner panel, a first surface of the inner panel contacting a second surface of the back panel; and walls positioned on sides of the back panel, the walls, the back panel and the inner panel collectively defining a recess, the wells including, a first hinge panel connecting a top panel to the back panel, a second hinge panel connecting a bottom panel to the back panel, a first side panel and a second side panel each connected to the back panel, a top front panel connecting the inner panel to the top panel, and a fourth surface of the first hinge panel and a fifth surface of the second hinge panel connected to the back panel.

21. The carton of claim 20, wherein the top panel at least partially forms a top surface of the carton, and a seventh surface of the top front panel contacts an eighth surface of the top front panel.

22. The carton of claim 20, wherein the walls include a bottom front panel that connects a lower bottom panel to the bottom panel, and an inside bottom panel that connects an upper bottom panel to the lower bottom panel.

23. The carton of claim 22, wherein the walls further include a bottom tuck panel extending from a first side edge of the upper bottom panel.

24. The carton of claim 22, wherein the lower bottom panel is in a third plane that is about parallel to a fourth plane of the upper bottom panel.

25. The carton of claim 22, wherein the lower bottom panel defines a first plurality of openings and the upper bottom panel defines a second plurality of openings, and each one of the first plurality of openings being aligned with a respective one of the second plurality of openings.

26. The carton of claim 22, wherein a tenth surface of the inside bottom panel contacts the second surface of the back panel.

27. The carton of claim 22, wherein a second fold line between the lower bottom panel and the inside bottom panel define at least one second slot, and at least one second tab extends from the inner panel, the at least one second tab being retained inside the at least one second slot.

28. The carton of claim 22, a pair of dust flaps are on a first end and a second end of each of the bottom panel and the lower bottom panel.

* * * * *